US011619420B2

(12) United States Patent
Michel

(10) Patent No.: US 11,619,420 B2
(45) Date of Patent: Apr. 4, 2023

(54) HVAC STAND ASSEMBLY

(71) Applicant: Salvadore Michel, Metairie, LA (US)

(72) Inventor: Salvadore Michel, Metairie, LA (US)

( * ) Notice: Subject to any disclaimer, the term of this patent is extended or adjusted under 35 U.S.C. 154(b) by 0 days.

(21) Appl. No.: 16/684,014

(22) Filed: Nov. 14, 2019

(65) Prior Publication Data

US 2021/0148602 A1 May 20, 2021

(51) Int. Cl.

| | |
|---|---|
| ***F24F 1/60*** | (2011.01) |
| ***F24F 13/32*** | (2006.01) |
| ***F16M 11/20*** | (2006.01) |
| ***F16M 11/22*** | (2006.01) |

(52) U.S. Cl.

CPC ..... *F24F 13/32* (2013.01)

(58) Field of Classification Search

CPC . F24F 1/60; F24F 13/32; F16M 11/20; F16M 11/22

USPC ..... 62/297; 165/67, 68

See application file for complete search history.

(56) References Cited

U.S. PATENT DOCUMENTS

| | | | | |
|---|---|---|---|---|
| 2,702,175 | A * | 2/1955 | Hanin | F24F 13/32 454/203 |
| 3,257,933 | A * | 6/1966 | Brian | F24F 13/32 454/203 |
| 4,916,918 | A | 4/1990 | Marelli | |
| 5,544,592 | A * | 8/1996 | Leezer | A47B 5/06 108/123 |
| 5,870,868 | A * | 2/1999 | Kita | E04C 2/384 52/309.9 |
| 6,631,878 | B1 | 10/2003 | Adam | |
| 7,334,421 | B1 | 2/2008 | Cantolino | |
| 7,798,465 | B1 | 9/2010 | Meverden | |
| 8,348,071 | B1 * | 1/2013 | Janlert | F16M 5/00 211/175 |
| 8,960,620 | B1 | 2/2015 | Merideth | |
| 9,052,120 | B2 | 6/2015 | Villar | |
| 10,030,809 | B1 * | 7/2018 | Rowland | F24F 1/60 |
| 2004/0149881 | A1 * | 8/2004 | Allen | F16M 7/00 248/676 |
| 2004/0221601 | A1 * | 11/2004 | Geary | F24F 5/0035 62/259.1 |
| 2008/0164390 | A1 | 7/2008 | Walker | |
| 2014/0075980 | A1 * | 3/2014 | Villar | F24F 13/32 62/297 |
| 2014/0090334 | A1 * | 4/2014 | Darby | E04G 3/18 52/741.1 |
| 2016/0187025 | A1 * | 6/2016 | Gates | F24F 13/32 248/542 |

(Continued)

*Primary Examiner* — Frantz F Jules
*Assistant Examiner* — Jason N Thompson
(74) *Attorney, Agent, or Firm* — Intellectual Property Consulting, LLC; Stephen M. Kepper

(57) ABSTRACT

A HVAC stand assembly for elevating an HVAC unit above flood waters includes a table that has an outdoor unit of a heating, ventilation and air conditioning system (HVAC) being positionable thereon. A plurality of legs is each pivotally coupled to the table to elevate the outdoor unit of the HVAC system above a support surface. Each of the legs has an adjustable length thereby facilitating the table to be elevated above the maximum height of flood waters. A plurality of engagements is each coupled to and extends laterally away from the table. Each of the engagements engages a building that is serviced by the outdoor unit of the HVAC system for securing the table.

10 Claims, 6 Drawing Sheets

(56) References Cited

U.S. PATENT DOCUMENTS

2019/0056143 A1* 2/2019 Zhang ..... F16M 13/02

* cited by examiner

HVAC STAND ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to stand devices and more particularly pertains to a new stand device for elevating an HVAC unit above flood waters.

(2) Description of Related Art Including Information Disclosed Under 37 CFR 1.97 and 1.98

The prior art relates to stand devices. The prior art includes a variety of stands for elevating an HVAC unit a fixed distance above a support surface. The prior art also discloses a stand that includes threaded lifters for adjusting a height of the HVAC unit. The prior art discloses a stand that is mountable in a fireplace opening to facilitate a window mounted air conditioner to be mounted in the fireplace opening. Additionally, the prior art discloses spacers that can be fixed to a support surface thereby facilitating the HVAC unit to be restrained on the support surface.

BRIEF SUMMARY OF THE INVENTION

An embodiment of the disclosure meets the needs presented above by generally comprising a table that has an outdoor unit of a heating, ventilation and air conditioning system (HVAC) being positionable thereon. A plurality of legs is each pivotally coupled to the table to elevate the outdoor unit of the HVAC system above a support surface. Each of the legs has an adjustable length thereby facilitating the table to be elevated above the maximum height of flood waters. A plurality of engagements is each coupled to and extends laterally away from the table. Each of the engagements engages a building that is serviced by the outdoor unit of the HVAC system for securing the table.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
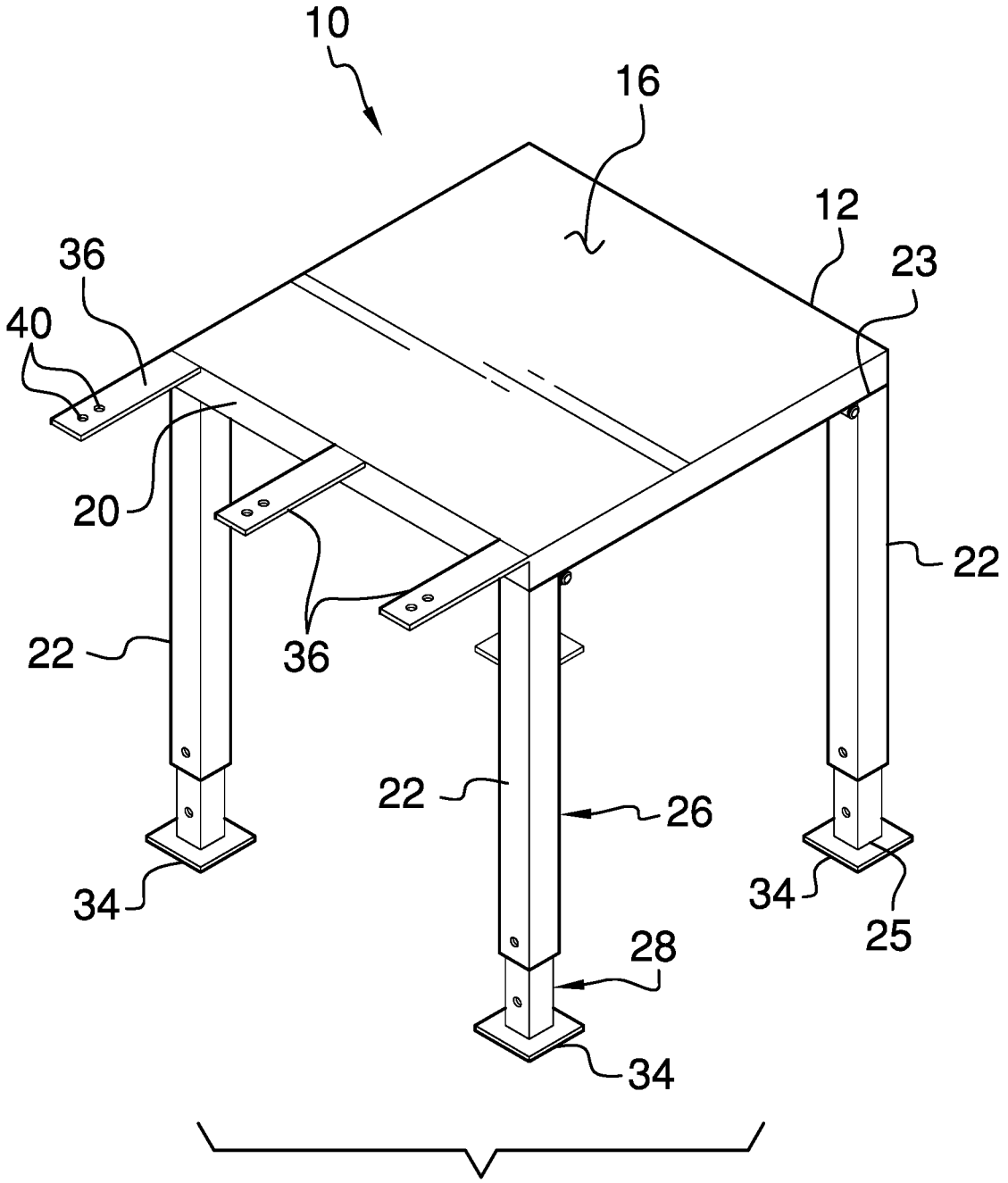
FIG. 1 is a top perspective view of a HVAC stand assembly according to an embodiment of the disclosure.
Figure 2:
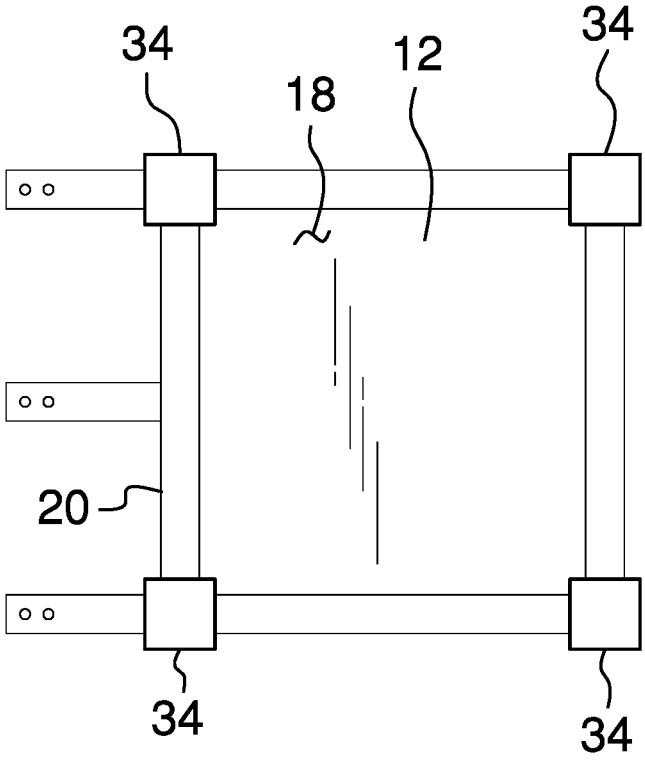
FIG. 2 is a bottom view of an embodiment of the disclosure.
Figure 3:
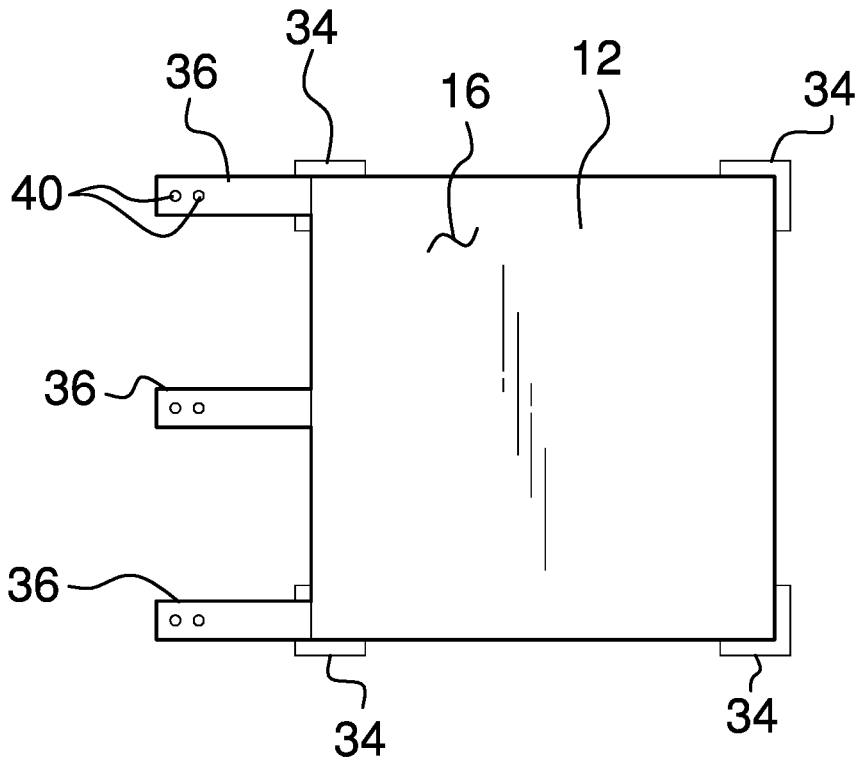
FIG. 3 is a top view of an embodiment of the disclosure.
Figure 4:
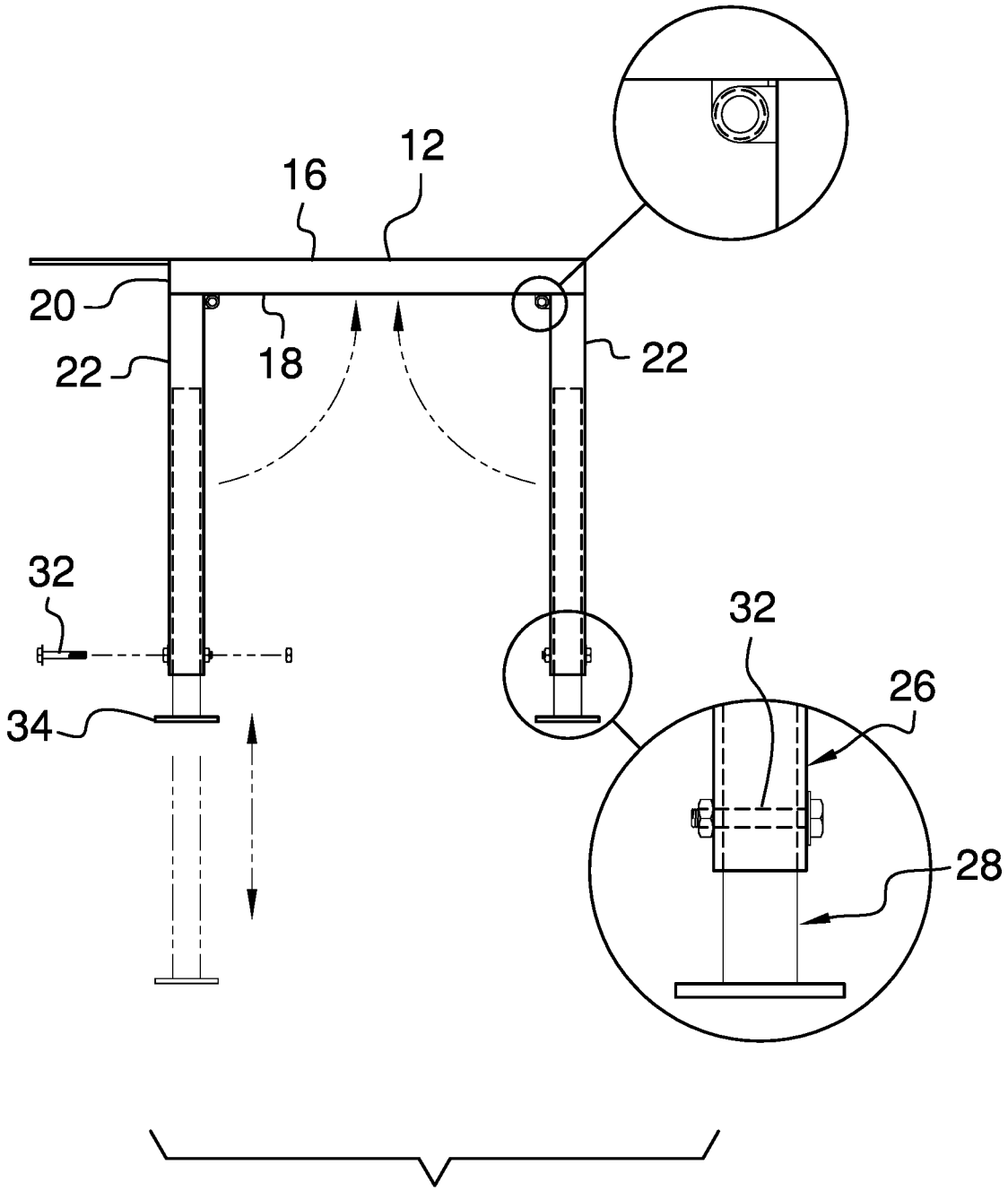
FIG. 4 is a right side view of an embodiment of the disclosure.
Figure 5:
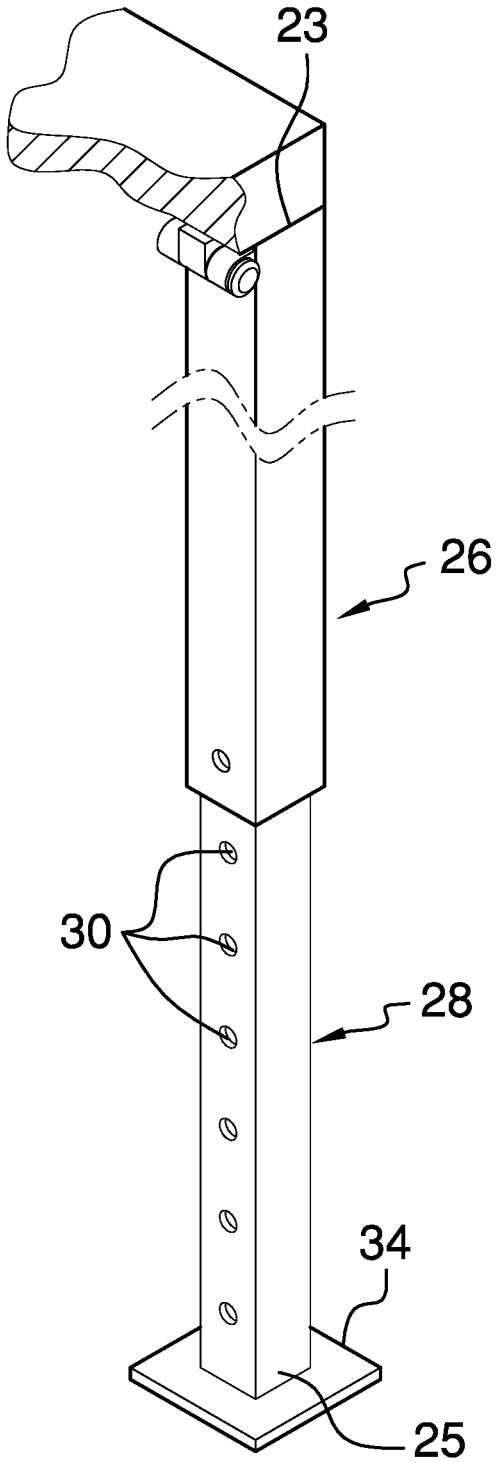
FIG. 5 is a perspective view of a leg of an embodiment of the disclosure.
Figure 6:
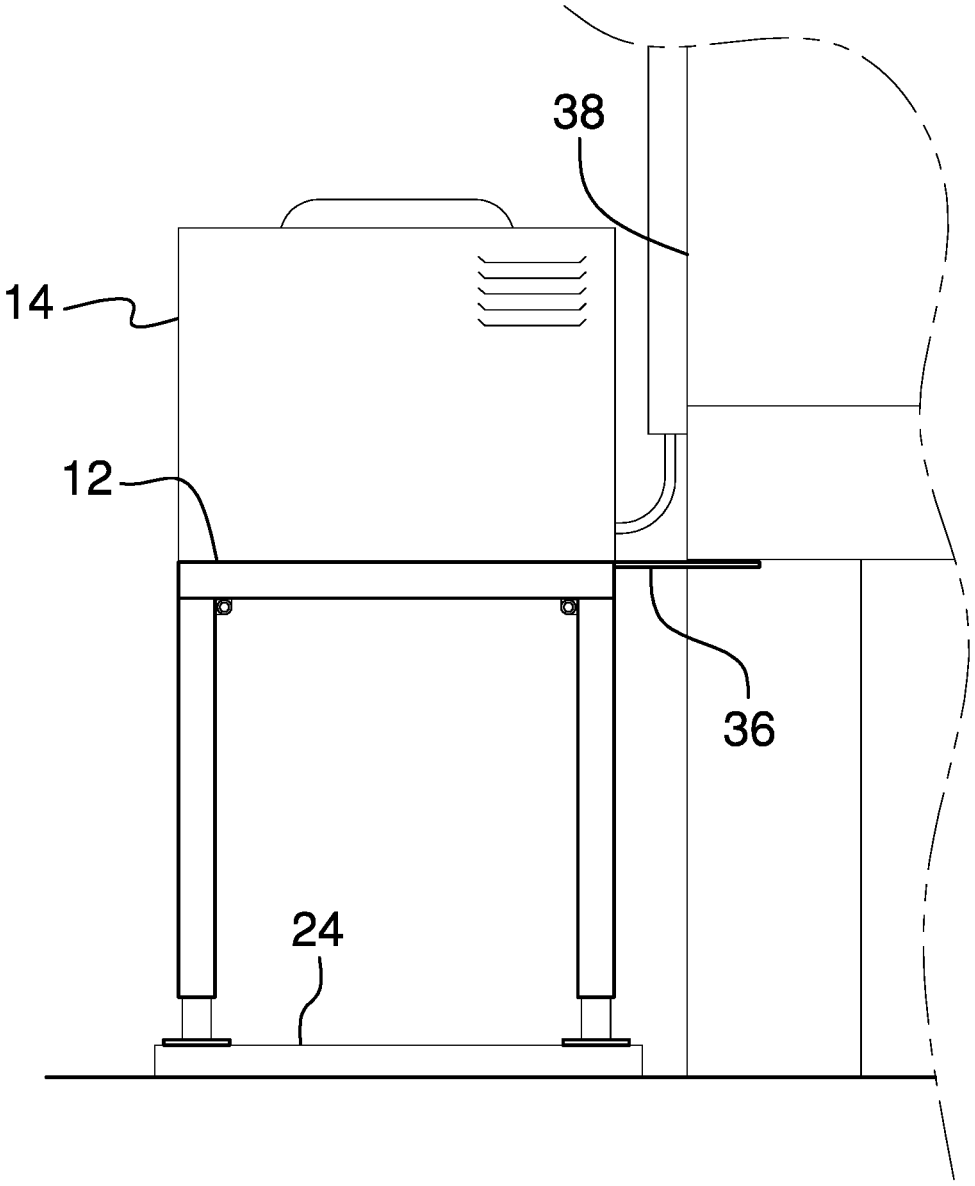
FIG. 6 is a perspective in-use view of an embodiment of the disclosure.

With reference now to the drawings, and in particular to FIGS. 1 through 6 thereof, a new stand device embodying the principles and concepts of an embodiment of the disclosure and generally designated by the reference numeral 10 will be described.

As best illustrated in FIGS. 1 through 6, the HVAC stand assembly 10 generally comprises a table 12 has an outdoor unit 14 of a heating, ventilation and air conditioning system (HVAC), and the outdoor unit 14 of the HVAC system is positioned thereon. The table 12 may be constructed of steel or other material that is resistant to being exposed to weather and the elements. The table has a top surface 16, a bottom surface 18 and a first edge 20, and the outdoor unit 14 of the HVAC system is positioned on the top surface 16. A plurality of legs 22 is each pivotally coupled to the table 12. The legs 22 are positionable in a deployed position having each of the legs 22 extending downwardly from the table 12. In this way the table 12 can elevate the outdoor unit 14 of the HVAC system above a support surface 24.

Each of the legs 22 has an adjustable length thereby facilitating the table 12 to be elevated above the maximum height of flood waters. In this way the table 12 can inhibit the outdoor unit 14 of the HVAC from being exposed to the flood waters. Each of the legs 22 has a top end 23 and a bottom end 25. Additionally, each of the legs 22 comprises a first portion 26 that slidably receives a second portion 28 such that each of the legs 22 has a telescopically adjustable length.

The top end 23 of each of the legs 22 is hingedly coupled to the bottom surface 18 of the table 12. Each of the legs 22 is aligned with a respective one of four corners of the bottom surface 18 of the table 12. The second portion 28 of each of the legs 22 has a plurality of apertures 30 extending therein and the apertures 30 are vertically distributed on the second portion 28. A plurality of pins 32 is provided and each of the pins 32 is extendable through the first portion 26 of a respective one of the legs 22. The pins 32 engage a respective one of the apertures 30 in the second portion 28 of the respective leg 22 for retaining the respective leg 22 at a desired height. The pins 32 may be threaded bolts and a plurality of nuts may be provided for retaining the bolts in the respective leg 22.

A plurality of feet 34 is each coupled to the bottom end 25 of a respective one of the legs 22 to abut the support surface 24. A plurality of engagements 36 is each coupled to and extends laterally away from the table 12. Thus, each of the engagements 36 can engage a building 38 that is being serviced by the outdoor unit 14 of the HVAC system. In this way the table 12 can be secured to the building 38. The building 38 may be a mobile home or other type of occupied building that is commonly found in flood zones. Each of the engagements 36 is positioned on the first edge 20 of the table 12. The engagements 36 are spaced apart from each other and are distributed along the first edge 20. Additionally, the table 12 is oriented such that the first edge 20 of the table 12 faces the building 38. Each of the engagements 36 has a plurality of fastener openings 40 extending therethrough for insertable 12 receiving a fastener that engages the building 38 for attaching the table 12 to the building 38. The fastener may be a bolt, a screw or other suitable 12 fastener.

In use, the legs 22 on the table 12 are positioned in the deployed position and each of the legs 22 is extended to the desired height. In this way the table 12 can be positioned at a height that is greater than the crest of flood waters in the area. Conversely, the legs 22 can be positioned in the stored position for placing the table 12 directly on the support surface 24. Each of the engagements 36 is fastened to the building 38 for securing the table 12 to the building 38. The outdoor unit 14 of the HVAC system is positioned on the table 12 to ensure that the outdoor unit 14 of the HVAC system is not exposed to flood waters. In this way the service life of the outdoor unit 14 of the HVAC system is enhanced.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An HVAC stand assembly being configured to elevate an outdoor unit of an HVAC system to a height sufficient to avoid flood waters, said assembly comprising:

a table operable to permanently support an entire weight of said outdoor unit of said HVAC system, said table having a top surface, a bottom surface and a first edge;

a plurality of legs, each of said legs being pivotally coupled to said table, said legs being positionable in a deployed position having each of said legs extending downwardly from said table wherein said table is operable to elevate the outdoor unit of the HVAC system above a support surface, each of said legs having an adjustable length thereby facilitating said table to be elevated to a desired height, each of said legs having a top end and a bottom end, each of said legs comprising a first portion slidably receiving a second portion such that each of said legs has a telescopically adjustable length, said top end of each of said legs being hingedly coupled to said bottom surface of said table, each of said legs being aligned with a respective one of four corners of said bottom surface of said table, said second portion of each of said legs having a plurality of apertures extending therein and being vertically distributed on said second portion;

a plurality of feet, each of said feet being coupled to said bottom end of a respective one of said legs independent from each other foot wherein each of said legs is independently adjustable, each of said feet having a planar bottom surface wherein each of said feet is configured to abut the support surface; and a plurality of elongate members, each elongate member comprising a proximal end and a distal end, each proximal end of each said elongate member being coupled to said first edge of said table, each distal end of each said elongate member extending laterally away a distance from said table, each of said elongate members being spaced apart from each other and being distributed along said first edge, said table being oriented having said first edge facing the building, wherein each distal end of each said elongate member is operable to secure said table to an exterior of a building being serviced by the outdoor unit of the HVAC system.

2. The assembly according to claim 1, further comprising a plurality of pins, each of said pins being extendable through said first portion of a respective one of said legs to engage a respective one of said apertures in said second portion of said respective leg for retaining said respective leg at a desired height.

3. The assembly according to claim 1, wherein each of said engagements having a plurality of fastener openings extending therethrough for insertable receiving a fastener that engages the building for securing said table to the building.

4. The assembly according to claim 1, wherein said HVAC system is positioned on said top surface.

5. The assembly according to claim 4, wherein said table supports the entire weight of said HVAC system.

6. The assembly of claim 1, wherein said table is attached to said building such that moving water flowing past said table is unable to change said distance between said table and said building.

7. An HVAC stand assembly being configured to elevate an outdoor unit of an HVAC system to a height sufficient to avoid flood waters, said assembly comprising:

a table operable to permanently support an entire weight of said outdoor unit of said HVAC system, said table having a top surface, a bottom surface and a first edge, a plurality of legs, each of said legs being pivotally coupled to said table, said legs being positionable in a deployed position having each of said legs extending downwardly from said table wherein said table is operable to elevate the outdoor unit of the HVAC system above a support surface, each of said legs having an adjustable length thereby facilitating said table to be elevated to a desired height, each of said legs having a top end and a bottom end, each of said legs comprising a first portion slidably receiving a second portion such that each of said legs has a telescopically adjustable length, said top end of each of said legs being hingedly coupled to said bottom surface of said table, each of said legs being aligned with a respective one of four corners of said bottom surface of said table, said second portion of each of said legs having a plurality of apertures extending therein and being vertically distributed on said second portion;

a plurality of pins, each of said pins being extendable through said first portion of a respective one of said legs to engage a respective one of said apertures in said second portion of said respective leg for retaining said respective leg at a desired height;

a plurality of feet, each of said feet being coupled to said bottom end of a respective one of said legs independent from each other foot wherein each of said legs is independently adjustable, each of said feet having a planar bottom surface wherein each of said feet is configured to abut the support surface; and a plurality of elongate members, each elongate member comprising a proximal end and a distal end, each proximal end of each said elongate member being coupled to said first edge of said table, each distal end of each said elongate member extending laterally away a distance from said table, wherein each distal end of each said elongate member is operable to engage an exterior of a building being serviced by the outdoor unit of the HVAC system for securing said table, said elongate members being spaced apart from each other and being distributed along said first edge, said table being oriented having said first edge facing the building, each of said engagements having a plurality of fastener openings extending therethrough for insertable receiving a fastener that engages the building for attaching said table to the building.

8. The assembly according to claim 7, wherein said HVAC system is positioned on said top surface.

9. The assembly according to claim 8, wherein said table supports the entire weight of said HVAC system.

10. The assembly of claim 7, wherein said table is attached to said building such that moving water flowing past said table is unable to change said distance between said table and said building.

* * * * *